United States Patent [19]

Henning

[11] Patent Number: 4,782,969

[45] Date of Patent: Nov. 8, 1988

[54] TWIST-OFF BOTTLE CAP

[75] Inventor: John C. Henning, Fairfield, Ohio

[73] Assignee: Product Investment Incorporated, Cincinnati, Ohio

[21] Appl. No.: 44,228

[22] Filed: Apr. 30, 1987

[51] Int. Cl.[4] ..... B65D 41/12

[52] U.S. Cl. ..... 215/295; 215/31; 215/328

[58] Field of Search ..... 215/31, 328, 295, 326, 215/327, 324, 325

[56] References Cited

U.S. PATENT DOCUMENTS

| | | | |
|---|---|---|---|
| 468,226 | 2/1892 | Painter . | |
| 1,693,117 | 11/1928 | McDonnell . | |
| 1,796,728 | 3/1931 | Sharp . | |
| 1,796,729 | 3/1931 | Sharp . | |
| 2,014,033 | 9/1935 | Smith | 215/31 |
| 2,069,075 | 1/1937 | Lunn | 215/295 |
| 2,173,785 | 9/1939 | Kniesche | 215/326 |
| 2,304,826 | 12/1942 | Jackson . | |
| 2,726,001 | 12/1955 | Culuci . | |
| 2,776,065 | 1/1957 | Loretitsch . | |
| 3,346,134 | 10/1967 | Leemann . | |
| 3,868,038 | 2/1975 | Hadley | 215/305 |
| 4,055,266 | 10/1977 | Amabili | 215/328 X |
| 4,114,775 | 9/1978 | Shinozaki | 215/324 |
| 4,595,110 | 6/1986 | Herr | 215/252 |

*Primary Examiner*—Donald F. Norton

*Attorney, Agent, or Firm*—Wood, Herron & Evans

[57] ABSTRACT

A tamper-proof closure is disclosed for use with a bottle having a neck, a lip with a downwardly and inwardly sloping peripheral wall and a plurality of outwardly extending ribs disposed at the juncture of the sloping wall and outer wall of the neck. The closure includes a top wall, a depending ribbed skirt and a plurality of rectangular tabs extending from the bottom edge of the skirt between each pair of ribs. The tabs are bent inwardly and upwardly and include a serrated edge for engagement with the ribs on the bottle. When the cap is applied, the tabs form compressive members holding the lid in sealed position against the bottle neck. The closure is removed by twisting, which causes the tabs to be shifted outwardly beyond the bottle ribs so that the cap can be lifted from the bottle. The closure cannot be reapplied since, during removal, the tabs have been bent outwardly to a point where they can no longer engage the bottle ribs.

17 Claims, 2 Drawing Sheets

TWIST-OFF BOTTLE CAP

BACKGROUND OF THE INVENTION

The present invention relates to closures for bottles and other containers and is particularly directed to a tamper-evident closure which will provide the user with a clear indication that the container has previously been opened. Many different closure caps have been used to seal bottles and other containers. One persistent problem with many of these closures is that they do not provide protection against unauthorized tampering with the contents of the container.

More particularly, the construction of conventional caps is such that they may be removed from the container, a contaminant injected into the contents and then the cap can be resealed so that there is no evidence that the container has been tampered with. Various container closures have been suggested to address this problem.

For example, Sharp U.S. Pat. Nos. 1,796,728 and 1,796,729 disclose caps for bottles constructed to have detents formed on the upper beads of the bottles. A thin metal cap is applied to the bottle so that the periphery of the cap assumes the contour of the detent. Subsequently, when the cap is rotated, the detents in the cap are forced outwardly so that the cap assumes a planar appearance. This is intended to provide an indication that the cap has been removed. However, the cap may be replaced on the container and, if pressure is applied about the periphery of the cap, the cap may again be given an irregular configuration so that an inattentive user may not realize that the cap had been previously opened.

Another deformable, but resealable, cap is shown in Amabili U.S. Pat. No. 4,055,266. This patent discloses a twist-off cap which includes one or more flanges disposed above its bottom edge. These flanges are turned under a bead on the bottle and are provided with a series of vertical lines of weakening. When the cap is removed, the flanges are distorted outwardly and either rupture or separate at the vertical lines of weakening to provide a visual indication that the cap has been removed. Again, however, the cap shown in this patent can be used to reseal the container and an inattentive user may not be alerted to the fact that the container had previously been opened.

A different form of tamper-evident closure is disclosed in Herr U.S. Pat. No. 4,595,110. This patent discloses a threaded cap including a security ring or band joined to the upper portion of the cap along a line of weakening. When the cap is unthreaded from the bottle, the band separates along the line of weakening and remains on the bottle. To insure that the band does not come off under the worst tolerance conditions, the band includes a plurality of inwardly-extending, thin plastic tabs which engage the bottle.

SUMMARY OF THE PRESENT INVENTION

The present invention is predicted upon the concept of providing a tamper-proof cap which cannot be reapplied to the bottle once it has been removed. Thus, the cap provides a clear warning to even the most inattentive user that a bottle has previously been opened.

More particularly, a preferred form of closure of the present invention is adapted for use with a bottle or container of the type having a neck with a lip formed on its outermost end. The lip includes a downwardly and inwardly sloping wall and a plurality outwardly-extending ribs disposed at the juncture of the sloping wall and outer wall of the neck. These ribs taper downwardly and extend outwardly from the neck at an obtuse angle to radii of the neck passing through the innermost ends of the ribs.

A preferred embodiment of a closure embodying the present invention is formed to include a circular top wall and a depending flange or skirt. The flange is provided with a plurality of spaced vertical stiffening ribs interconnected by webs. A plurality of tabs are formed along the lower edge of the flange intermediate the ribs. In a preferred form, these tabs are rectangular and include a serrated transverse edge. The tabs are bent inwardly and upwardly.

The cap can be applied to the bottle by a generally conventional capping machine of the type including a plunger which fits over the cap and presses the flange inwardly around the bottle neck. This forces the tabs upwardly into engagement with the downwardly facing ribs, the serrated edges of the tabs fitting over the ribs and being displaced inwardly along the ribs which function as threads.

In accordance with the present invention, the tabs are dimensioned so that they function as compressive members and hold the lid tightly against the upper rim of the bottle to provide an airtight seal.

The present cap is removed by initially twisting the cap by hand to cause the tabs to be shifted outwardly along the ribs beyond their outer ends. The cap can then be lifted from the bottle. In this process, the tabs are bent further outwardly by the sloping outer wall of the lip until the cap is pulled free from the bottle. Once the cap has been removed, it cannot be relocked on the bottle since the tabs cannot be forced inwardly to a position in which they can reengage the ribs. Thus, once a closure has been removed, unmistakable evidence is provided that the bottle has been opened.

In a modified embodiment, a separate lid is provided for resealing the bottle once the outer protective closure has been removed. In this modification, the bottle is provided with an annular groove in the outer rim of the neck surrounding the pouring opening. A flat removable lid is inserted in this opening before the main closure cap is applied. When the closure is removed, the inner lid can be opened to provide access to the contents of the bottle and can be reapplied to reseal the bottle. The fact that the bottle has been opened is, of course, obvious because the original closure cap is not in place.

The invention will be more readily understood from a consideration of the following detailed description of the drawings illustrating preferred embodiments of the invention.

DETAILED DESCRIPTION OF A PREFERRED EMBODIMENT

In accordance with the present invention, a crown closure or cap 10 is used for closing and sealing a bottle, or other container, having a neck 11 including a lip 12 surrounding the pouring opening 13. The cap is adapted to be applied to the end of the bottle and locked in position by generally conventional capping machinery and is thereafter adapted to be removed from the bottle by an initial twisting motion followed by a motion lifting the cap from the bottle. Once removed, the cap cannot be relocked on the bottle without the use of very complicated machinery.

Figure 10:
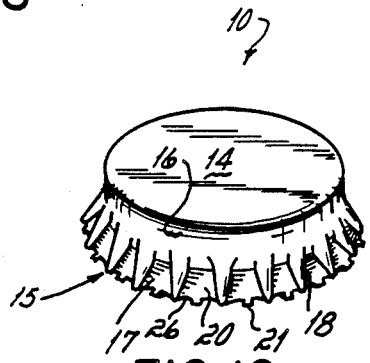
FIG. 10 is a perspective view of a cap of the present invention in its pre-formed condition before application to a bottle top.

As shown in FIG. 10, the cap 10 includes a generally flat top wall 14 of circular outline. A peripheral flange, or skirt, 15 depends from the top wall. This skirt includes a generally vertical portion 16 and an outwardly flared lower portion 17. As is conventional in crown-type closures, the lower portion of vertical wall section 16 and flared portion 17 are "corrugated" and include a plurality of radial ribs 18 of generally U-shaped cross-section. These ribs are separated by webs or valleys 20.

In addition to these elements, the present closure comprises a plurality of radial tabs 21 extending from the outer edge of each of the webs 20 intermediate each pair of adjacent ribs 18. In the preferred embodiment, the tabs are of generally rectangular configuration and include a transverse outer edge 22 provided with a plurality of teeth 23. It is to be understood that the relative length and width of tabs 22 is selected so that these tabs function as compressive members, i.e., they provide the optimum downward force upon the cap to provide a light seal when it is in the locked position shown in FIG. 6.

The cap is provided to the bottlers in the pre-formed shape shown in FIG. 10. As is well known to those skilled in the art, the undersurface of the top wall 14 carries a sealing gasket member 24 formed of a suitable plastic composition.

Figure 1:
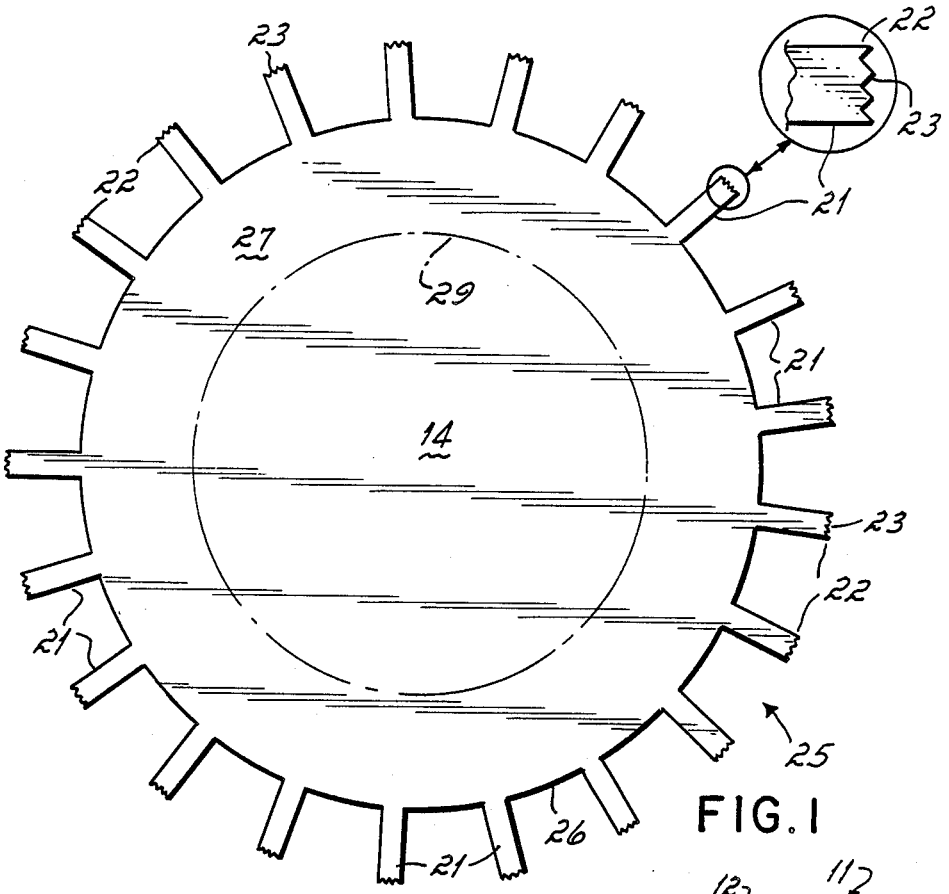
FIG. 1 is a top plan view of a blank for forming the cap of the present invention and an enlargement of the end of one locking tab.

The cap 10 is originally formed from a blank 25 as illustrated in FIG. 1. The blank, which is preferably formed of a suitable metallic material, such as aluminum or thin steel, is of a generally circular configuration having a circumferential edge 26 which forms the lowermost edge of the pre-formed cap.

Figure 5:
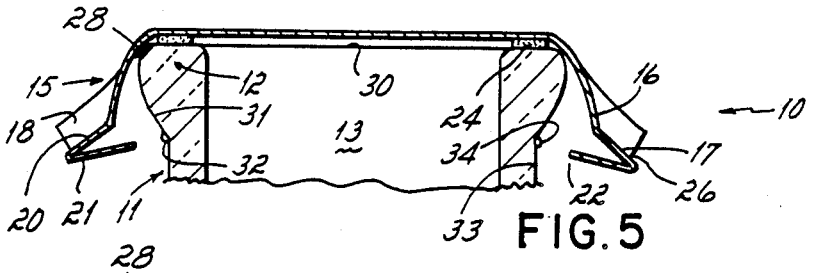
FIG. 5 is a vertical cross-sectional view through the upper portion of the bottle neck and cap showing a pre-formed cap as it is initially brought into contact with the pouring lip of the bottle.

Tabs 21 extend outwardly from circumferential edge 26, the tabs being equi-spaced about the circumference of blank 25. In pre-forming the cap to the configuration shown in FIG. 10, the annular portion 27 of blank 25 is bent downwardly along a circle indicated by dashed line 29. This leaves the central circular top wall portion 14 within the dashed line and the depending flange portion formed outside of the dashed line. Tabs 21 are bent inwardly so as to form an acute angle with web portions 20 as illustrated in FIG. 5. The angulation of tabs 21 is such that the tabs slope upwardly from the horizontal with the edge 22 of the tab being disposed above outer edge 26 of the flange.

Figure 2:
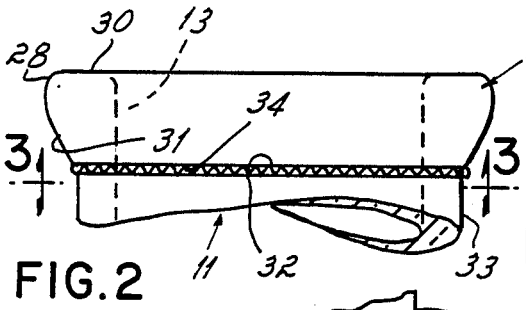
FIG. 2 is a side elevational view of the upper portion of the neck of a preferred form of bottle configurated in accordance with the present invention.
Figure 3:
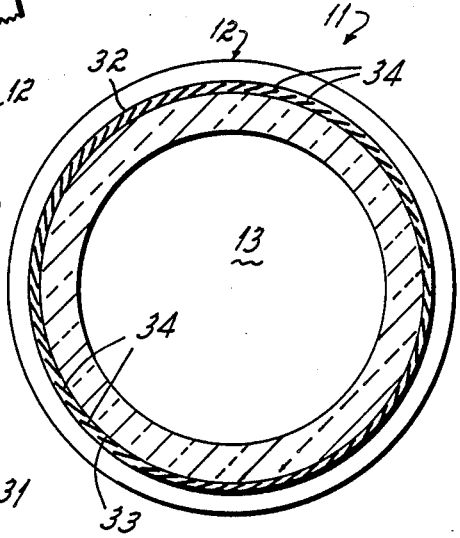
FIG. 3 is a cross-sectional view taken along line 3—3 of FIG. 2.
Figure 4:
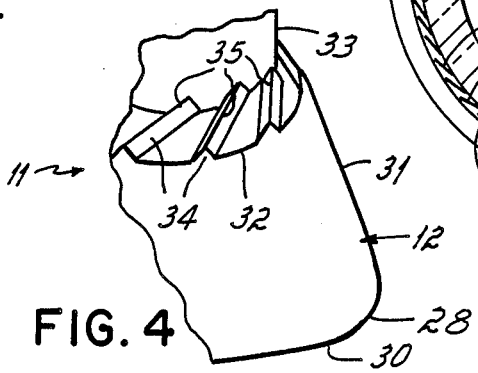
FIG. 4 is an enlarged perspective view looking upwardly toward the locking ribs formed on the bottle of FIG. 2.

Cap 10 is particularly adapted for use with a bottle or other container having a neck 11 configurated as shown in FIGS. 2–4. As there shown, neck 11 includes an axial central pouring opening 13 which is surrounded by a lip 12. Lip 12 preferably includes a curved upper portion 28 which joins the upper edge 30 of the neck and a downwardly and inwardly sloping surface 31. A horizontal shoulder 32 is formed on the lower portion of lip 12 and extends between a cylindrical wall 33 of the neck and sloping outer wall 31 of lip 12.

As best shown in FIGS. 3 and 4, a plurality of ribs 34 extend downwardly from shoulder 32. Ribs 34 extend outwardly from cylindrical wall 33 at an obtuse angle to a radius of neck 11 passing through the juncture of the inner end of rib 34 and the neck. Ribs 34 are triangular in cross-section, tapering downwardly from shoulder 32 to a linear bottom edge 35. It is to be understood that there are a substantially larger number of ribs 34 than tabs 21, e.g., two to three times as many.

In use, caps 10 are supplied to the bottler in the pre-formed condition shown in FIG. 10. In the initial step of applying the cap to the bottle, the cap is placed over the end of neck 11 of the bottle with gasket 24 in engagement with the upper edge 30 of the bottle. The bottle is closed using a capping machine, not shown. Those skilled in the art are familiar with the construction of such capping machines, the details of which constitute no part of the present invention.

Figure 6:
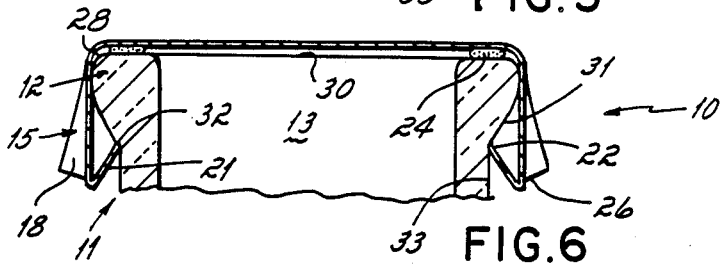
FIG. 6 is a cross-sectional view similar to FIG. 5 in which the flange of the cap has been forced inwardly so that the cap is in its sealed and locked position in the bottle.

Suffice it to say, the machine includes a vertically shiftable annular plunger which is effective, when lowered, to fit over the cap and engage the depending flange 15 of the cap to bend that flange inwardly from the position shown in FIG. 5 to the fully closed position illustrated in FIG. 6. As the closing machine presses the flange 15 inwardly, tabs 21 are shifted inwardly to bring the edges 22 of the tabs into engagement with the ends of ribs 34.

As the tabs are forced still further inwardly, the notches between each pair of teeth 23 ride over the edges 35 of ribs 34 so that the notches straddle the ribs. Tabs 21 are thereby placed in compression. They are of sufficient strength so that they do not buckle, but rather cause a downward force to be exerted on flange 15 of the cap. As a result, the top of the cap is pulled downwardly and gasket 24 is tightly compressed against upper rim 30 of the bottle neck to seal the bottle opening. As explained above, the tabs 21 are dimensioned so that they have sufficient compressive strength to apply the necessary sealing load on a cap.

Figure 7:
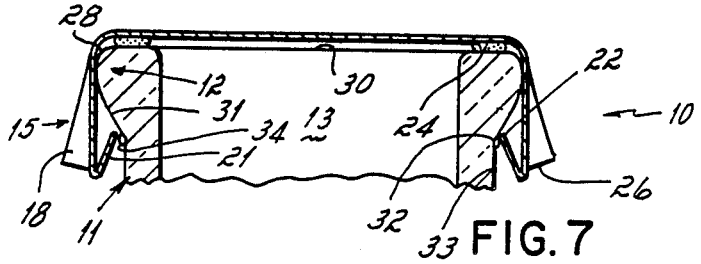
FIG. 7 is a cross-sectional view similar to FIG. 6 showing the cap after it has been unthreaded and the tabs have been forced outwardly beyond the locking ribs.

When it is desired to remove the cap 10, the cap is rotated counterclockwise by hand. As the cap rotates in this direction, the notches in the ends of the tabs in engagement with ribs 34 are forced outwardly beyond the ends of ribs 34 to the position shown in FIG. 7. Once the tabs have reached this position, the cap can be freely turned in either direction without reengaging the tabs and ribs and relocking the cap.

In order to complete the removal of the cap, it is simply lifted upwardly. When this is done, the free edges 22 of the tabs engage sloping surface 31 of lip 12 and are bent outwardly. As the cap continues to be lifted, the tabs 21 are bent, or cammed, by the sloping surface 31 to a position shown in FIG. 8 in which they clear the maximum circumference of lip 12, permitting the cap to be lifted entirely free of the bottle.

Figure 8:
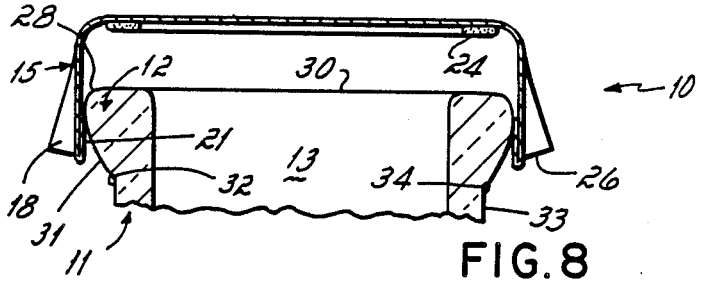
FIG. 8 is a cross-sectional view similar to FIG. 7 in which the unthreaded cap has been partially lifted from the bottle.

Once the cap has been removed, tabs 21 remain bent outwardly. If an attempt is made to reseat the cap on the bottle, the cap will pass downwardly over the lip 12 with tabs 21 generally assuming their position as shown in FIG. 8. However, when the cap is completely lowered to bring gasket 24 into contact with upper edge 30 of the bottle, the tabs 21 remain bent outwardly to an extent that they cannot engage ribs 34. As a result, turning of the cap will not cause the tabs to be shifted into locking engagement with the ribs and the cap cannot be relocked by hand on the top of the bottle. Consequently, a truly tamper-proof bottle closure is provided.

Figure 9:
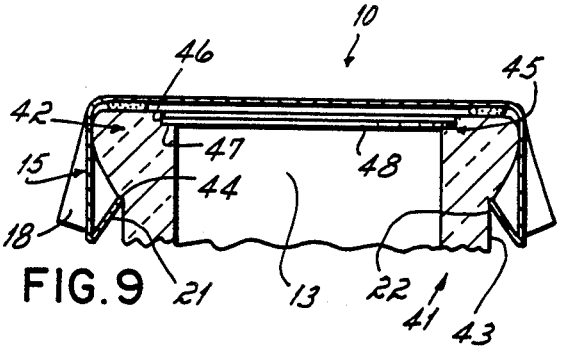
FIG. 9 is a cross-sectional view similar to FIG. 6 showing a closure of the present invention positioned over a modified bottle fitted with a replaceable inner sealing lid.

In the event that it is desired to combine the tamper-proof features of a cap 10 with the ability to reseal the bottle, a modified form of bottle construction is used as illustrated in FIG. 9. As there shown, the modified bottle includes a neck 41 having a lip 42 similar to lip 12. The modified bottle neck 41 also includes a cylindrical wall section 43 identical to wall section 33 and ribs 44 identical with ribs 34.

The bottle of FIG. 9 differs from the previously-described bottle in that it includes an annular recess 45 surrounding pouring opening 13. This recess forms an annular vertical shoulder 46 and a horizontal shoulder 47. A lid 48 is adapted to be disposed in recess 45 in abutment with shoulders 46 and 47. This lid is placed in the recess prior to the application of cap 10. Once the cap has been removed in the manner described above, lid 48 can be removed from, and later replaced in, recess 45 to open and close the bottle without the use of cap 10.

From the foregoing disclosure of the general principles of the present invention and the above description of a preferred embodiment, those skilled in the art will readily comprehend various modifications to which the invention is susceptible. Thus, for example, the transverse ends of tabs 21 can be straight rather than serrated. Therefore, I desire to be limited only by the scope of the following claims.

Having described my invention, I claim:

1. A tamper-proof cap for a container of the type having a neck with a central pouring opening and an outer lip surrounding the end of said neck, said cap comprising:

a top wall;

a depending peripheral flange, said flange being configurated to form a plurality of vertical ribs and a plurality of webs interconnecting said ribs;

tabs extending from said webs, each of said tabs having a transverse free edge, said tabs being bent inwardly and being dimensioned to engage a surface on said bottle adjacent said lip and apply a downwardly sealing force on said top wall.

2. The cap of claim 1 in which said tabs are generally rectangular.

3. The cap of claim 1 in which the outer ends of said tabs are serrated.

4. The cap of claim 1 in which said tabs are inclined upwardly.

5. A container for use with a tamper-proof closure, said container comprising:

a neck having an outer wall and a pouring opening therethrough;

an end-wise lip surrounding said pouring opening, said lip including a sloping peripheral wall extending downwardly and inwardly;

a plurality of outwardly extending ribs formed adjacent to the juncture of said sloping peripheral wall and said outer wall;

said ribs tapering downwardly and including lower edges extending outwardly at an obtuse angle to radii of said neck.

6. The container of claim 5 in which said ribs are of triangular configuration.

7. The container of claim 5 further including a horizontal shoulder disposed intermediate the lower portion of said sloping peripheral wall and said outer wall, said ribs extending downwardly from said shoulder.

8. The container of claim 5 further comprising an annular recess surrounding said pouring opening.

9. The combination of a container comprising a neck having an outer wall and a pouring opening therethrough;

an endwise lip surrounding said pouring opening, said lip including a sloping peripheral wall extending downwardly and inwardly;

a plurality of outwardly extending ribs formed adjacent to the juncture of said sloping peripheral wall and said outer wall;

a tamper-proof cap comprising a top wall;

a depending peripheral flange, said flange being configurated to form a plurality of vertical ribs and a plurality of webs interconnecting said ribs;

tabs extending from said webs, each of said tabs having a transverse free edge, said tabs being bent inwardly and being dimensioned to engage a surface on said bottle adjacent said lip and apply a downwardly sealing force on said top wall.

10. The combination of claim 9 in which said tabs are generally rectangular.

11. The combination of claim 10 in which said tabs are inclined upwardly.

12. The combination of claim 9 in which the outer ends of said tabs are serrated.

13. The combination of claim 9 in which said ribs extend outwardly at an obtuse angle to radii of said neck.

14. The combination of claim 9 in which said ribs taper downwardly.

15. The combination of claim 9 in which said ribs are of triangular configuration.

16. The combination of claim 9 further including a horizontal shoulder disposed intermediate the lower portion of said sloping peripheral wall and said outer wall, said ribs extending downwardly from said shoulder.

17. The combination of claim 9 further comprising an annular recess surrounding said pouring opening and a removable lid disposed in said annular recess.

* * * * *